United States Patent [19]

Nissler et al.

[11] Patent Number: 4,941,007

[45] Date of Patent: Jul. 10, 1990

[54] APPARATUS FOR PROCESSING PHOTOGRAPHIC MATERIAL TO BE DEVELOPED

[75] Inventors: Siegfried Nissler; Miroslav Radomirevic, both of Leinfelden-Echterdingen, Fed. Rep. of Germany

[73] Assignee: Autopan Heimerdinger & Stäbler GmbH & Co., Leinfelden-Echterdingen, Fed. Rep. of Germany

[21] Appl. No.: 342,955

[22] Filed: Apr. 24, 1989

[30] Foreign Application Priority Data

Apr. 23, 1988 [DE] Fed. Rep. of Germany ..... 3813771
Dec. 31, 1988 [DE] Fed. Rep. of Germany ... 8816224[U]

[51] Int. Cl.[5] ..... G03D 3/08

[52] U.S. Cl. ..... 354/320; 226/171; 226/189

[58] Field of Search ..... 354/320, 321, 322; 226/189, 190, 194, 170, 171, 172, 173

[56] References Cited

U.S. PATENT DOCUMENTS

| | | | |
|---|---|---|---|
| 1,585,408 | 5/1926 | Morse | 134/64 P |
| 2,913,973 | 11/1959 | Bull et al. | 226/189 |
| 3,678,842 | 6/1972 | Reid | 134/64 P |
| 4,002,280 | 1/1977 | Coleman et al. | 226/189 |
| 4,019,667 | 4/1977 | Falomo | 226/189 |
| 4,174,901 | 11/1979 | Takita et al. | 226/189 |

*Primary Examiner*—A. A. Mathews
*Attorney, Agent, or Firm*—Toren, McGeady & Associates

[57] ABSTRACT

An apparatus for processing photographic material to be developed, including at least one container provided so as to receive a processing liquid, a conveyor arrangement located in the container for conveying the material to be developed through the processing liquid, the conveyor arrangement including two reversing rollers and at least one conveyor belt endlessly revolving around the two reversing rollers, and an arrangement for retaining the material to be developed at an outer surface of the at least one conveyor belt, at least one of the two reversing rollers being displaceable in a conveying direction of the at least one conveyor belt.

11 Claims, 6 Drawing Sheets

APPARATUS FOR PROCESSING PHOTOGRAPHIC MATERIAL TO BE DEVELOPED

BACKGROUND OF THE INVENTION

The present invention relates to an apparatus suitable for processing photographic material to be developed, which apparatus consists of at least one container for receiving a processing liquid as well as a conveyor arrangement located in this container which conveys the material to be developed through the processing liquid. The conveyor includes one or several conveyor belts endlessly revolving around two reversing rollers, or the like, as well as means retaining the material to be developed at the external surface of these conveyor belts.

In appliances of the above-mentioned type, there continues to exist the difficulty that the conveyor belts revolving around the reversing rollers do not shrink to the same extent because of the processing liquid acting upon them. Thus, shrinkage tensions arise, which entail destruction of the fixed bearings of the redirection rollers. These stresses of the shrinking belts additionally produce a squeezing pressure acting upon the material to be developed which often entails difficulties, especially in the lower reversing region.

SUMMARY OF THE INVENTION

Accordingly, it is an object of the present invention to eliminate these difficulties arising with a rigid support of the redirection rollers and to create a structural shape, which permits compensation for the shortening of the conveyor belts caused by shrinkage, and where the tension of the conveyor belts can at any time be adjusted to a predetermined value.

Pursuant to this object, and others which will become apparent hereafter, one aspect of the present invention resides in at least one of the two reversing rollers being displaceable and fixable in the conveyance direction of the one or the several conveyor belts, especially counter to the spring action. By such a displaceable support of the one redirection roller, the distance to the axis of the other redirection roller can be changed at any time and thus can also be adapted to the respective length of the more or less shrunk conveyance belts.

In a particularly expedient embodiment, several contact pressure rollers are properly assigned to the displaceably supported reversing roller, which together with the mentioned reversing roller constitute a displaceable and immobilizable set of rollers. Such a set of rollers herein advantageously comprises two bearing plates arranged on both sides of the rollers and serving for their support, which plates themselves are again displaceable and immobilizable counter to the spring action. Thus, for instance, there exists the possibility that only the lower set of rollers is displaceable and immobilizable, wherein then at least one threaded bore open towards the bottom is configured in the lower edge of each of the two bearing plates. A threaded shank of a clamping or tightening screw engages into the threaded bore so as to abut with its head against the adjacent support of the conveyance arrangement and which is subject to the action of the spring.

In another embodiment, the components which are displaceable and immobilizable against each other in a known manner are under the action of at least one compensation spring, especially a spiral pressure spring.

This permits the taking up of the shrinkage stresses arising during shrinkage of the conveyor belts by the compensation spring located between these two components, wherein the components shift against each other in the same amount as the conveyor belts shrink and thus an appropriate shortening of the distance spacers occurs to the extent respectively desirable.

Further details of the present invention are discernible from the following description of the preferred embodiments depicted in the drawing.

DETAILED DESCRIPTION OF THE PREFERRED EMBODIMENTS

Figure 1:
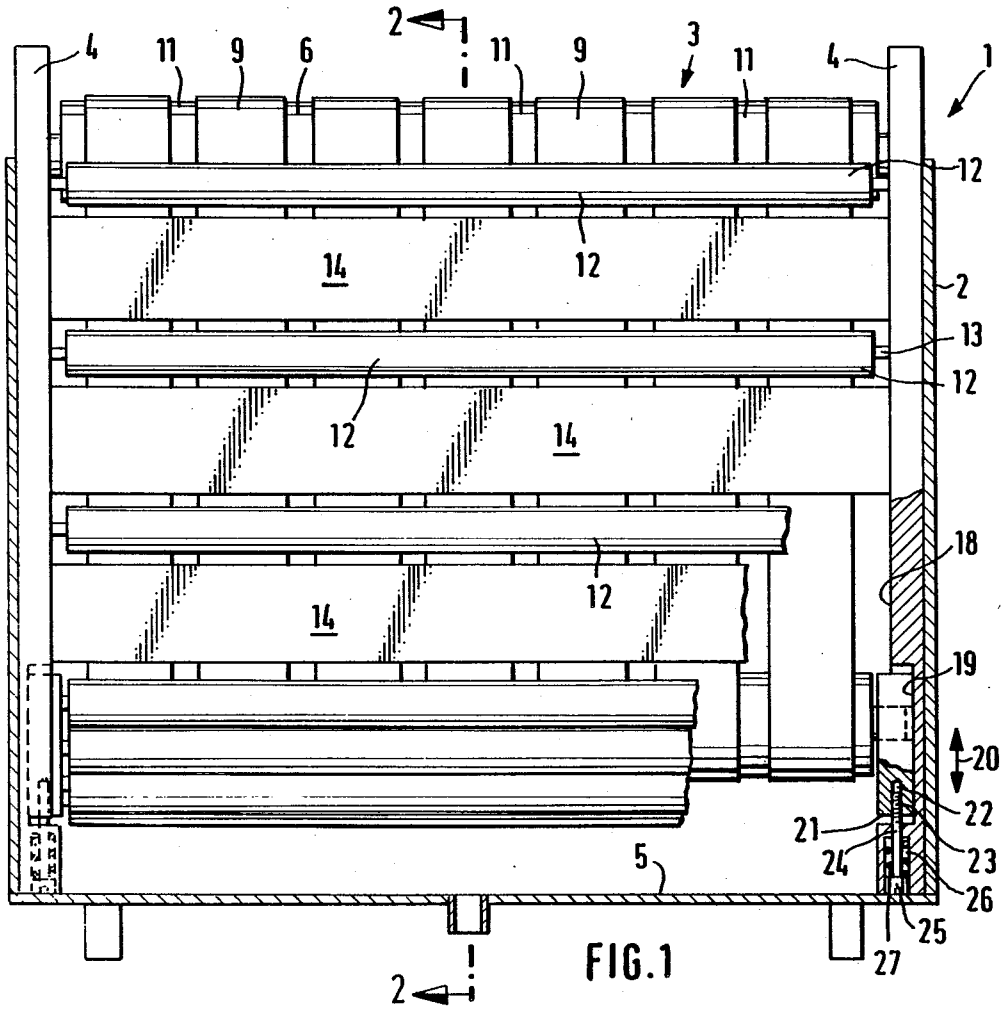
FIG. 1 is a partially sectioned side view of the apparatus pursuant to the present invention.

The apparatus 1 depicted in a side view in the FIG. 1 consists of a container 2, shown in section, and serving for receipt of a processing liquid, as well as a conveyor device 3 placed from above into this container 2, which sits upon the container bottom 5 with by two vertical support beams 4. Two reversing rollers 6, 7 are located between these two supports 4, and have shafts 8 oriented horizontally and made to revolve by means not depicted here. Seven conveyor belts, designated with 9, and arranged next to each other are placed around these redirection rollers 6, 7, and rotate endlessly together with the redirection rollers 6, 7 in the direction of arrow 10. Intermediate spaces respectively located between adjacent conveyor belts 9 are designated 11.

Figure 2:
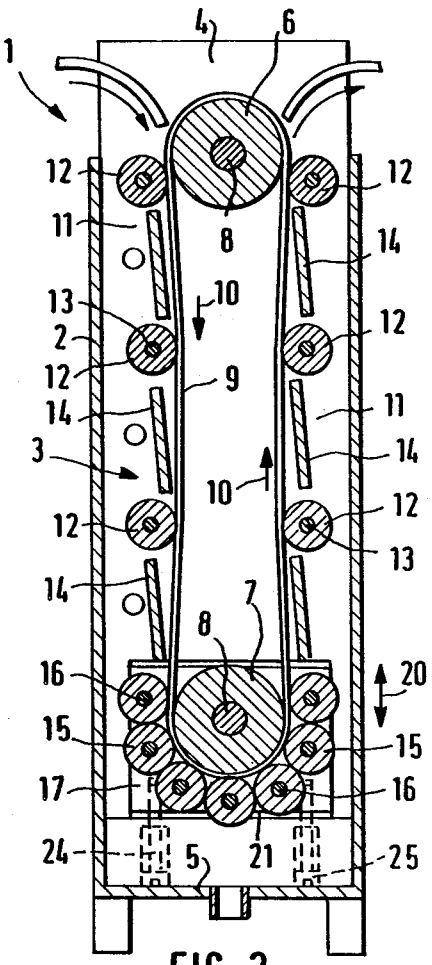
FIG. 2 is a section along the line 2—2 in FIG. 1.

As can be discerned further from FIGS. 1 and 2, outer auxiliary or feed rollers 12 are assigned to the conveyor belts 9, and extend across the entire width of these conveyor belts 9. These rollers 12 are also supported by means of shafts 13 in the support beams 4 of the conveyor arrangement 3. In order to assure good guidance of the material to be developed, which is not depicted here, also in the regions located between these feed rollers 12, and above all in order to avoid a possible deviation of said material to be developed, guide panels 14 are arranged respectively between the feed rollers 12 and are inclined as illustrated in FIG. 2 so as to direct the material to be developed to the next feed roller 12.

Additional auxiliary or feed rollers 15 are assigned to the lower reversing roller 7. Feed rollers 15 have shafts 16 arranged in an approximate semi-circle around the shaft 8 of the lower reversing roller 7. These feed rollers press the material to be developed together with the revolving conveyor belts 9 against the lower reversing roller 7. The lower reversing roller 7 and the feed roller 15 are supported on both sides by means of their shafts 8 and 16 in two bearing plates 17. These bearing plates 17 are supported so as to be displaceable in the direction of vertical arrows 20 in recesses 19 configured in the inner walls 18 of the support beams 4, as discerned from FIG. 1. Two threaded bores 22 are spaced from each other and located in the lower end edges 21 of the bearing plates 17. The threaded shank 23 of a tightening screw 24 engages with the bores and has a head 25 which abuts at the support beam 4 concerned by means of a helical pressure spring 27 supported in a vertical bore in the support beam 4. The conveyor belt 9 can be stretched to such an extent or, however, also relieved by means of the tightening screws 24 so that the belt tension corresponds to the predetermined tension value. The spiral pressure springs 27 permit at any time a diversion of the entire set of rollers consisting of the lower reversing roller 7 and the feed rollers 15 assigned to it, in case the material to be developed has a greater thickness or if an additional shrinkage of the conveyor belt 9 has occurred in the meantime. The retightening of these tightening screws 24 or also a loosening or relieving of them can be accomplished simply and rapidly by the operator of the device, without specialized personnel being required for the purpose.

Figure 3:
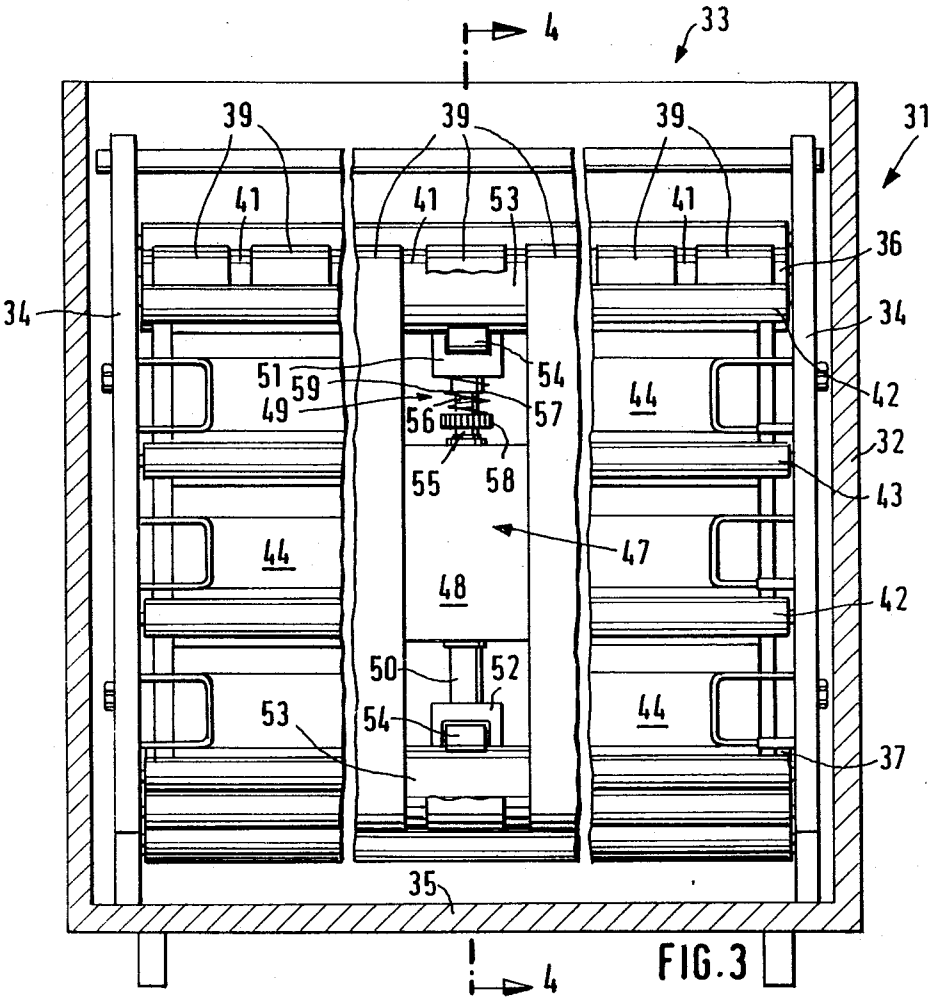
FIG. 3 is a partially sectioned side view of another embodiment of the present invention.

The apparatus 31 depicted in a side view in FIG. 3 consists of a container 32, depicted in section and serving to receive the processing liquid, as well as a conveyor arrangement 33 placed into the container 32 from the top. The conveyor arrangement 33 sits on the bottom of the container 35 with its two vertical support beams 34. Two reversing rollers 36, 37 are located between these two support beams 34, and have shafts 38 oriented horizontally which can be made to rotate by means not depicted here. Seven conveyor belts 39 arranged next to each other are placed around these reversing rollers 36, 37. The conveyor belts 39 revolve endlessly together with the reversing rollers 36, 37 in the direction of the arrows 40. Intermediate spaces respectively located between adjacent conveyor belts 39 are designated with 41.

Figure 4:
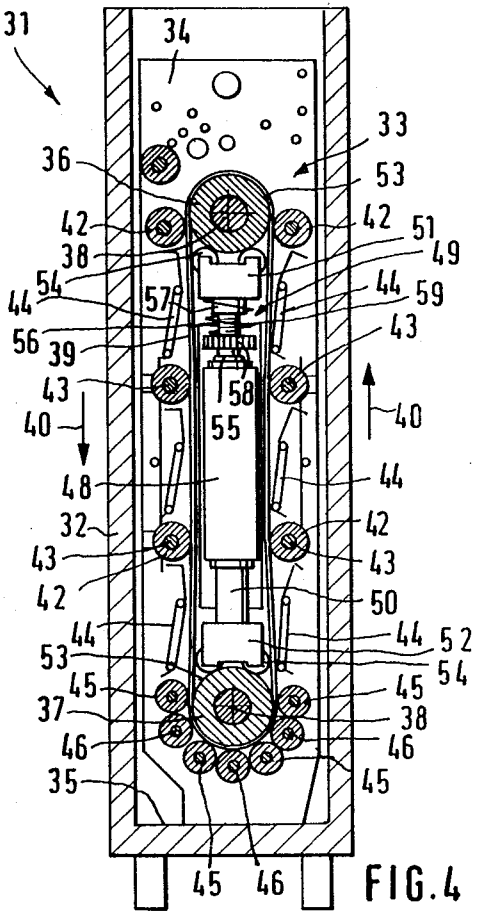
FIG. 4 is a section along the line 4—4 in FIG. 3.

As can be furthermore discerned from FIGS. 3 and 4, outer feed rollers 42 are assigned additionally to the conveyor belts 39, and extend across the entire widths of the conveyor belts 39 and are also supported in the support beams 34 of the conveyor arrangement by means of their shafts 43. In order to assure good guidance of the material to be developed, which is not depicted here, also in the regions located between these feed rollers 42 and in order to above all avoid a possible deviation of same, guide plates 44 are respectively arranged between these feed rollers 42. Furthermore, several feed rollers 45 are assigned to the lower reversing roller 37, whose shafts are arranged approximately in a semi-circle around the shaft 38 of the lower reversing roller 37 so as to press the supplied material to be developed together with the revolving conveyor belts 39 against the lower reversing roller 37.

In order to carry the forces exerted by the stretched conveyor belts 39 upon the reversing rollers 36, 37 with the comparatively large width of the conveyor arrangement 33, and so as to avoid bending stresses in the reversing rollers 36, 37, a distance spacer 47 is arranged in the central region of both reversing rollers 36, 37 and between the conveyor belts 39, whose central component is designated with 48. Two supports 49, 50 are arranged on both sides of the central component 48, which carry one bearing block 51, 52 respectively. These bearing blocks 51, 52 are again equipped with two backup rollers 54 which rest flush against the contour surface 53 of the reversing rollers 36, 37 concerned. The axes of rotation of these auxiliary rollers are oriented parallel to the axes of rotation of the reversing rollers 36, 37.

While the lower support 50 is fabricated in one piece and is rigidly connected on the one side with the middle components 48 and on the other side with the associated bearing block 52, the upper support 49 consists of a threaded bolt 55 fixedly connected with the central component 48, whose threaded shank 56 engages so as to be longitudinally displaceable into a bore configured in the bearing block 51 and lengthened by a sleeve 57, or the like. A knurled nut 58 is threaded upon this threaded bolt 55, which nut 58 serves as counterbearing for a spiral pressure spring 59 also placed upon the threaded shank 56. The spring 59 abuts on the side facing away from the serrated nut 58 against the end face of the bearing block 51 facing the central component 48. Because of the longitudinally displaceable support of the bearing block 51 with respect to the central component 48, the distance spacer 47 can at any time adapt to the respectively actually existing spacing between the two reversing rollers 36, 37, independently of the point in time when the shrinkage of the conveyor belt, mentioned above, occurs. The spiral pressure spring 59, abutting on the one side at the knurled nut 58 and on the other side at the bearing block 51, assures herein at any time a flush contact of the backup rollers 57 supported in the two bearing blocks 51 and 52 against the outer surface area 53 of the reversing rollers 36 and 37. Thus the adjustment of the hitherto used adjustment screws necessary up to now from time to time by specialized personnel is no longer required.

Figure 6:
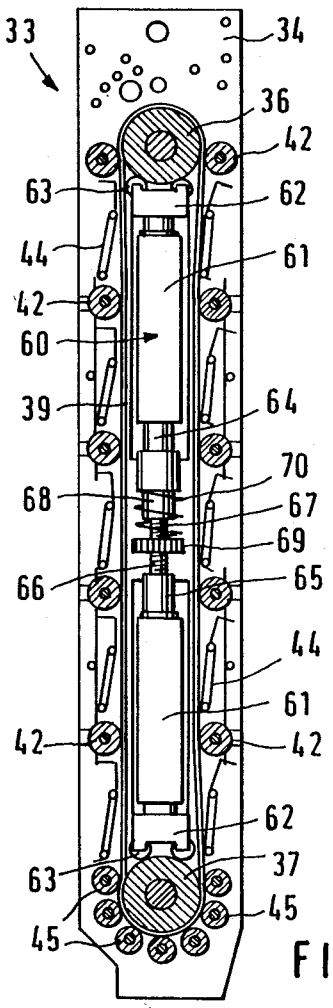
FIGS. 5 and 6 illustrate another embodiment of the conveyor device in view similar to FIGS. 3 and 4.
Figure 5:
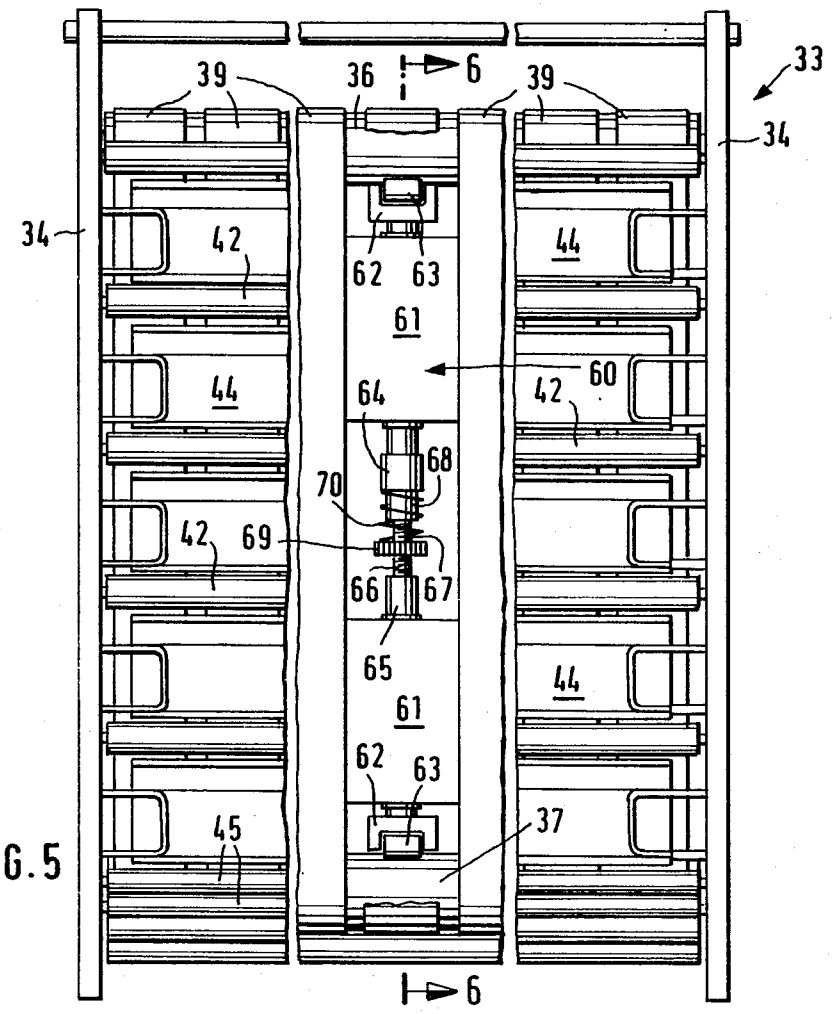

The following FIGS. 5 and 6 show another embodiment of the conveyor arrangement 36, wherein the respective identical components are designated by the same references numbers. Another distance spacer designated 60 has been provided in this case instead of the previously dealt with distance spacer 47, which consists of two components 61 and two bearing blocks 52 solidly abutted in these two components 61 with identical backup rollers 63. Two supports in 64, 65 are again arranged between the two components 61, wherein the lower support 65 again comprises a threaded bolt 66 whose threaded shank 67 engages so as to be longitudinally displaceable into a bore configured in the upper support 64, which bore is also extended by a sleeve 68 and upon which also a knurled nut 69 is threaded on. This knurled nut 69 serves herein again for the abutment of a spiral pressure spring 70, which on the other side again abuts at the opposite end face of the upper support 64. The functional mode of this spiral pressure spring 70 as well as the knurled nut 69 is herein the same as has been explained in the previously discussed embodiment.

Figure 8:
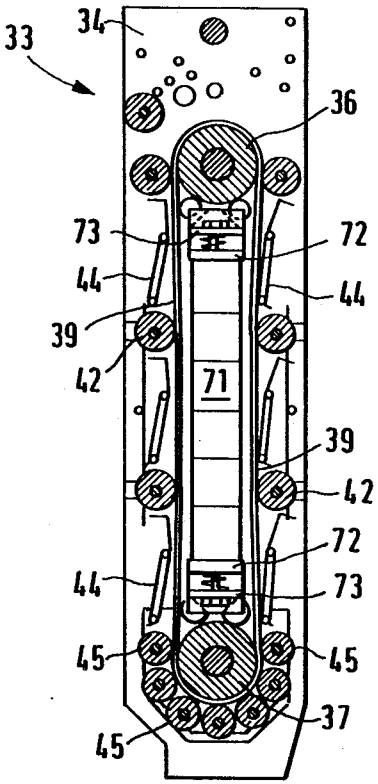
FIGS. 7 and 8 illustrate a further embodiment of the conveyor arrangement.
Figure 7:
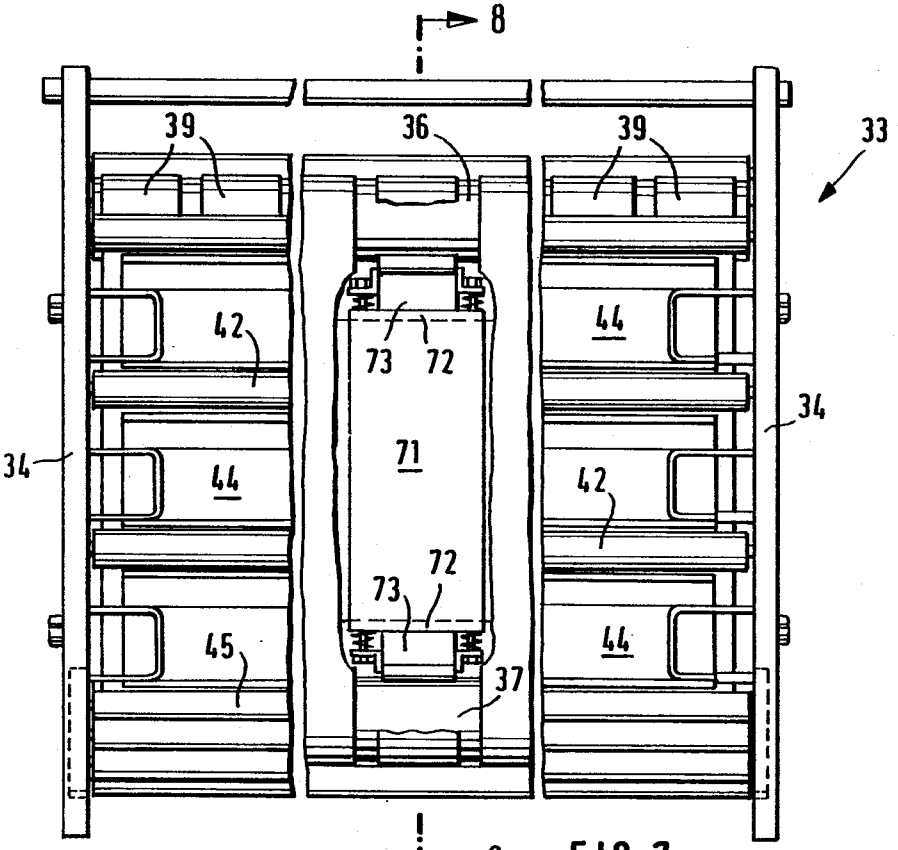
Figure 12:
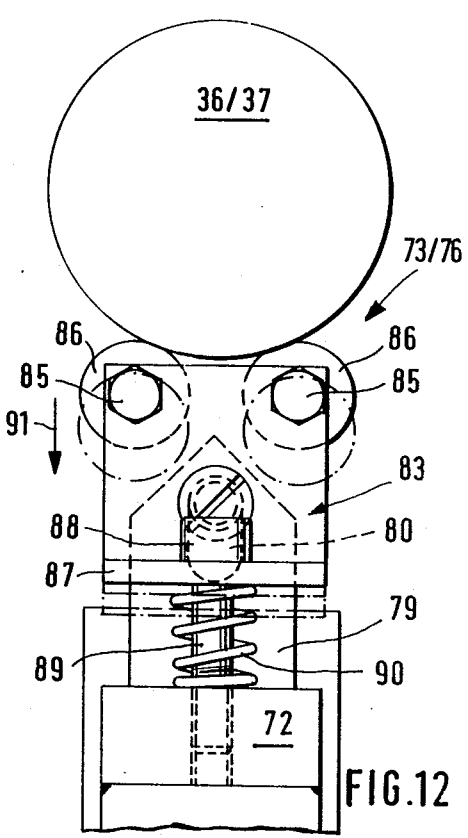
FIGS. 11 and 12 show a special design of one of the bearing blocks.
Figure 11:
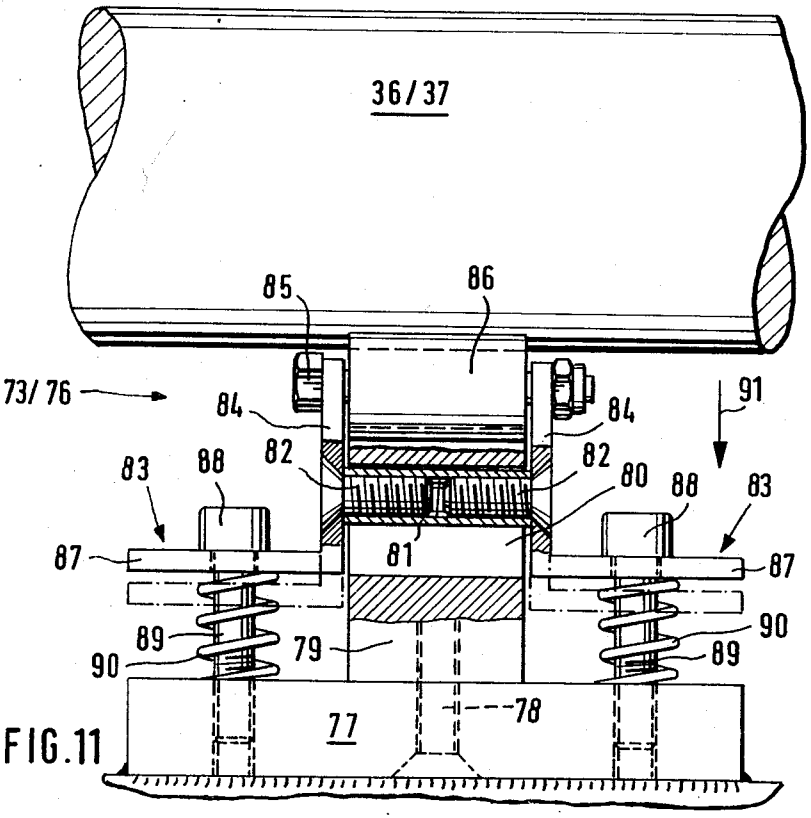

According to a third embodiment, depicted in FIGS. 7 and 8, such a distance spacer 71 also comprises a middle portion 72 at both of whose end faces 72 facing the reversing rollers 36, 37, respectively, one support arrangement 73 subsequently explained with particularity in connection with FIGS. 11 and 12 is provided.

Figure 10:
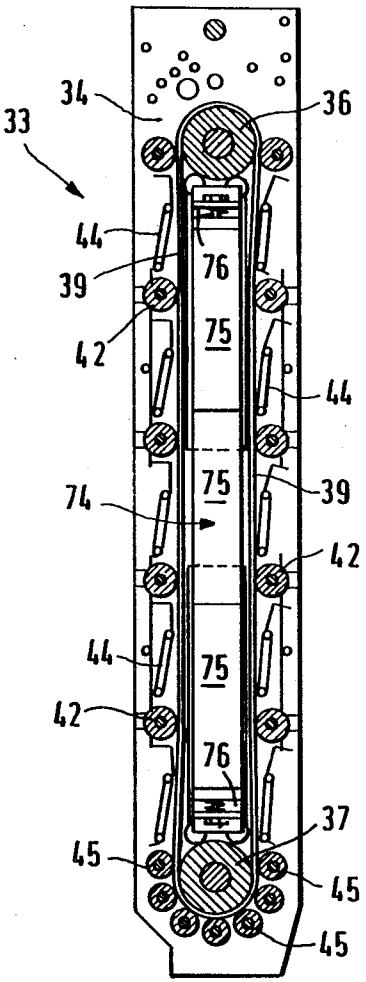
FIGS. 9 and 10 illustrate yet another embodiment of the invention.
Figure 9:
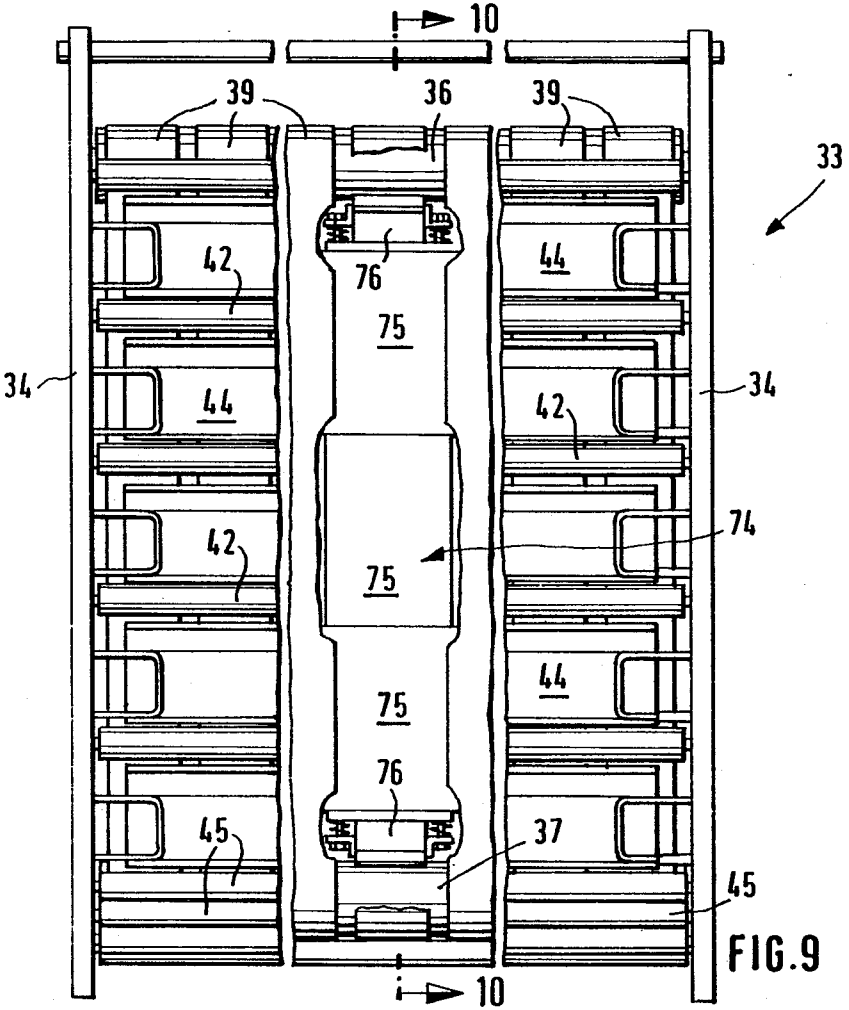

As far as the following FIGS. 9 and 10 are concerned, they show a last embodiment of such a distance spacer 74, which in this case is composed of three central components 75 interengaging in telescoping fashion and is equally equipped on both sides with one support arrangement 76, respectively.

As far as the previously mentioned support arrangement 73/76 is concerned, it comprises a plate 77 to which a bearing piece 79 is screwed on by means of a bolt 78. An elongated hole 80 parallel to the adjacent reversing rollers 36/37 is located in this bearing part 79, which elongated hole serves for receiving and supporting a horizontal threaded sleeve with 81. Two screws 82 engage into this threaded sleeve 81, by means of which two angle irons 83 are connected with the threaded sleeve 81. The vertically oriented legs 84 of the angle irons 83 serve herein for attachments and support of two backup rollers 86 revolving upon respectively one threaded bolt 85 and resting at the adjacent reversing roller 36/37. The horizontally oriented legs 87 of these angle irons 83 on the other hand are connected with the plate 77 by vertical screws 88 and abut elastically at said plate through helical pressure springs 90 supported on the vertical threaded shanks 89. These helical pressure springs 90 assure herein at all times a flush contact of the backup rollers 86 at the adjacent reversing roller 36/37, permitting however simultaneously also an elastic deviation of these backup rollers 86, wherein these together with the two angle irons 83 and the threaded sleeve 81 supported in the elongated hole 80 and connecting said angle irons with each other are then slightly shifted in direction of the arrow 91.

While the invention has been illustrated and described as embodied an apparatus for processing photographic material to be developed, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

1. An apparatus for processing photographic material to be developed, comprising:

at least one container provided so as to receive a processing liquid;

conveyor means located in said container for conveying the material to be developed through the processing liquid, said conveyor means including two reversing rollers and at least one conveyor belt endlessly revolving around said two reversing rollers;

means for retaining the material to be developed at an outer surface of said at least one conveyor belt, at least one of said two reversing rollers being displaceable in a conveying direction of said at least one conveyor belt; and at least one spring arranged so that said reversing roller is displaceable and immobilizable against the action of said spring.

2. An apparatus according to claim 1, and further comprising several contact pressure rollers assigned to said at least one reversing roller so as to form together with said reversing roller a displaceable and immobilizable set of rollers.

3. An apparatus according to claim 2, wherein said set of rollers includes two support plates arranged on both sides of said rollers so as to support said rollers, said support plates being displaceable and immobilizable counter to the action of said spring.

4. An apparatus according to claim 3, wherein at least one downwardly opening threaded bore is configured in the lower edge of each support plate, said conveyor means further including an adjacent support beam; and further comprising a tightening screw subjected to the action of a spring so as to abut itself at the adjacent support beam of said conveyor means.

5. At apparatus for processing photographic material to be developed, comprising:

at least one container provided so as to receive a processing liquid;

conveyor means located in said container for conveying the material to be developed through the processing liquid, said conveyor means including two reversing rollers and at least one conveyor belt endlessly revolving around said two reversing rollers;

means for retaining the material to be developed at an outer surface of said at least one conveyor belt, at least one of said two reversing rollers being displaceable in a conveying direction of said at least one conveyor belt; and at least one distance spacer arranged between said reversing rollers, said spacer including at least two components displaceable and immobilizable against each other in their longitudinal axis and backup rollers located at both its ends so that said spacer abuts at a respective outer contour surface of reversing rollers opposite each other, and at least one compensating spring means provided so as to subject said at least two components to spring action.

6. An apparatus according to claim 5, wherein said compensating spring means includes a helical pressure spring.

7. An apparatus according to claim 5, wherein said compensating spring means is arranged in between said two components located in tandem along the longitudinal axis of said distance spacer; and further comprising bearing blocks rigidly fastened on opposite ends of said components so as to carry two backup rollers having two axes of rotation parallel to each other.

8. An apparatus according to claim 5, wherein said distance spacer includes a central component and two bearing blocks located at both its ends, and comprising, respectively, two backup rollers having axes of rotation parallel to each other, at least one of the bearing blocks being supported so as to be displaceable along the longitudinal axis of the distance spacer with respect to the central component and being subjected to the action of said compensating spring means.

9. An apparatus according to claim 8, wherein both bearing blocks are supported so as to be displaceable with respect to the central component, said compensating spring means including a separate compensation spring assigned to each bearing block.

10. An apparatus according to claim 5, wherein said compensating spring means is configured to be a helical pressure spring and is supported at a threaded bolt arranged at one component so that it abuts, on one side, at a knurled nut threaded upon the threaded bolt and serves as one of an adjustable counterbearing and abutment and, on the other side, at the other component.

11. An apparatus according to claim 7, wherein the bearing block carrying the two backup rollers is articulated at one support part so as to be able to perform a pendular motion around an axis parallel to the longitudinal axis of the adjacent reversing roller, said bearing block abutting at an adjacent component of the distance spacer through two helical pressure springs each supported on a separate threaded bolt.

* * * * *